US010600357B2

(12) United States Patent
Yang

(10) Patent No.: US 10,600,357 B2
(45) Date of Patent: Mar. 24, 2020

(54) METHOD AND SYSTEM FOR SPECKLE PHENOMENON OF DISPLAY IMAGE

(71) Applicant: Wuhan China Star Optoelectronics Technology Co., Ltd., Wuhan, Hubei (CN)

(72) Inventor: Yong Yang, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 278 days.

(21) Appl. No.: 15/579,173

(22) PCT Filed: Nov. 15, 2017

(86) PCT No.: PCT/CN2017/111034

§ 371 (c)(1),
(2) Date: Dec. 1, 2017

(87) PCT Pub. No.: WO2019/085025

PCT Pub. Date: May 9, 2019

(65) Prior Publication Data

US 2019/0385516 A1 Dec. 19, 2019

(30) Foreign Application Priority Data

Oct. 31, 2017 (CN) ..... 2017 1 1048739

(51) Int. Cl.

| | |
|---|---|
| ***G09G 3/3208*** | (2016.01) |
| ***G09G 3/20*** | (2006.01) |
| ***G09G 3/36*** | (2006.01) |

(52) U.S. Cl.
CPC ..... *G09G 3/3208* (2013.01); *G09G 3/2003* (2013.01); *G09G 3/36* (2013.01);
(Continued)

(58) Field of Classification Search
CPC ..... G09G 3/3208; G09G 3/2003; G09G 3/36; G09G 5/10; G09G 5/02
See application file for complete search history.

(56) References Cited

U.S. PATENT DOCUMENTS 7,463,251 B2 * 12/2008 Giraldo ..... G09G 3/32 345/204
7,865,041 B1 * 1/2011 Ma ..... G06T 3/4007 382/299

(Continued)

*Primary Examiner* — Sardis F Azongha
(74) *Attorney, Agent, or Firm* — Hemisphere Law, PLLC; Zhigang Ma

(57) ABSTRACT

An improvement method for speckle phenomenon of a display image includes: a display device respectively displaying a first black-and-color grid image and a second black-and-color grid image; black and color grins of the first black-and-color grid image and black and color grins of the second black-and-color grid image are complementary, size of black and color grins of the first black-and-color grid image and the second black-and-color grid image is same as pixel size of the display panel; and acquiring a pixel gray scale of the first black-and-color grid image the display device displays; the display device displaying an image according to the acquired pixel gray scales and a driving frequency. The method calibrates the pixel gray scale of the display device by way of compensation and algorithm to achieve brightness uniformity of the display screen and reduce or eliminate the speckle phenomenon caused by the AG cover glass.

14 Claims, 3 Drawing Sheets

(52) U.S. Cl.
CPC . *G09G 2300/0452* (2013.01); *G09G 2320/02* (2013.01); *G09G 2320/0666* (2013.01)

(56) References Cited

U.S. PATENT DOCUMENTS

| | | | | |
|---|---|---|---|---|
| 8,085,467 | B1 * | 12/2011 | Silverstein | G03B 21/60 359/443 |
| 8,730,139 | B2 * | 5/2014 | Yamauchi | G09G 3/3611 345/87 |
| 9,911,395 | B1 * | 3/2018 | Townsend | G09G 5/10 |
| 2013/0069924 | A1 * | 3/2013 | Robinson | G09G 3/20 345/207 |
| 2013/0321369 | A1 * | 12/2013 | Mirski-Fitton | G09G 3/3208 345/207 |
| 2017/0270877 | A1 * | 9/2017 | Li | G06T 7/13 |
| 2019/0191153 | A1 * | 6/2019 | Speigle | H04N 17/04 |

* cited by examiner

METHOD AND SYSTEM FOR SPECKLE PHENOMENON OF DISPLAY IMAGE

RELATED APPLICATIONS

The present application is a National Phase of International Application Number PCT/CN2017/111034, filed Nov. 15, 2017, and claims the priority of China Application No. 201711048739.X, filed Oct. 31, 2017.

FIELD OF THE DISCLOSURE

The present invention belongs to the field of display technology, and particularly relates to an improvement method and an improvement system for speckle phenomenon of a display image.

BACKGROUND

In general, when using a mobile terminal such as a mobile phone in a bright environment, people often have high intensity reflection and glare interference, so that the mobile terminal's quality content cannot be read clearly.

In order to overcome this defect, the commonly used method at present is to perform surface treatment of anti-reflection and anti-reflection on the cover surface of the mobile terminal. The hardware processing method can largely overcome the reflected light and the glare on the surface of the mobile terminal. However, the use of the anti-glare and anti-reflection cover glass in the high-resolution display panel can also cause the sparkle phenomenon and affect the comfort of reading degree. Thereby, people continue to improve the surface treatment technology anti-glare and anti-reflection cover in order to reduce or eliminate speckle phenomenon, however, there are limits to improve the process, and may not be able to largely eliminate the speckle phenomenon. At the same time, improvement of surface treatment technology is relatively slow, is not harmful to the rapid application of anti-glare and anti-reflection cover promotion.

SUMMARY

In order to solve the above drawbacks of the prior art, an object of the present invention is to provide an improvement method and system for a speckle appearance of a display image.

According to an aspect of the present invention, there is provided an improvement method for a speckle appearance of a display image, including the steps of: a display device respectively displaying a first black-and-color grid image and a second black-and-color grid image; the display device comprises a display panel and an anti-glare cover attached to the display panel, black and color grids of the first black-and-color grid image and black and color grids of the second black color grid image are complementary, and size of the black and color grids of the first black-and-color grid image and the second black-and-color grid image is same as pixel size of the display panel, and number of the black grid and color grids is same as number of pixel size of the display panel; acquiring a pixel gray scale of the first black-and-color grid image the display device displays and a pixel gray scale of the second black-and-color grid image the display device displays; the display device displaying an image according to the acquired pixel gray scales and a driving frequency of the display panel.

Further, the step of displaying the image according to the obtained the gray scales of the pixel and the driving frequency of the display panel further comprises: if the driving frequency of the display panel is 120 Hz, compensating the acquired gray scale of the pixel; the compensated pixel gray scales associated with the first black-and-color grid image are provided to the pixels located in odd-numbered rows and odd-number columns and to the pixels are located in even-numbered rows and even-numbered columns, and the compensated pixel gray scales associated with the second black-and-color grid image are provided to the pixel located in the odd-numbered rows and odd-number columns and to the pixel located in the even-numbered rows and even-number columns.

Further, the step of displaying the image according to the acquired the pixel gray scale and the driving frequency of the display panel further comprises: compensating the pixel gray scale acquired if the driving frequency of the display panel is 60 Hz; synthesizing the compensated pixel gray scale associated with the first black-and-color grid image and the compensated pixel gray scale associated with the second black-and-color grid image; providing the synthesized pixel gray scale for the pixel of a corresponding position of the display panel.

before the display device separately displays the first black-and-color grid image and the second black color grid image, the improvement method further comprises: the display device displays a 0 grayscale black image for brightness calibration; the display device respectively displays a first black-and-white grid image and a second black-and-white grid image; the black and white grids of the first black-and-white grid image and the second black-and-white grid image are complementary to each other, and size of the first black-and-white grid image and the second black-and-white grid image is the same as the pixel size of the display device; positioning the black and white grids in the first black-and-white grid image and the second black-and-white grid image.

According to another aspect of the present invention, there is also an improvement system for speckle phenomenon of a display image, the improvement system comprises: a display device and an acquisition device, the display device comprises a display panel and a cover glass bonded to the display panel; the display device is configured to respectively display a first black-and-color grid image and a second black-and-color grid image; the black and color grids of the first black-and-white grid image and the second black-and-white grid image are complementary to each other; and size of black of color grids of the first black-and-color grid image and the second black-and-color grid image are the same as the pixel size of the display panel; the acquisition device is configured to acquire a pixel gray scale of the first black-and-color grid image the display device displays and a pixel gray scale and the second black-and-color grid image the display device displays; the display device is further configured to display an image according to the acquired pixel gray scale and a driving frequency of the display panel.

Further, the display device is further configured to compensate the obtained pixel gray scale when the driving frequency of the display panel is 120 Hz, and the compensated pixel gray scales associated with the first black-and-color grid image are provided to the pixels located in odd-numbered rows and odd-number columns and to the pixels are located in even-numbered rows and even-numbered columns, and the compensated pixel gray scales associated with the second black and white grid image are provided to the pixels located in the odd-numbered rows and odd-number columns and located in the even-numbered rows and even-number columns.

Further, the display device is further configured to compensate the acquired pixel gray scale when the driving frequency of the display panel is 60 Hz, the compensated pixel gray scale associated with the first black color grid image and the compensated pixel gray scale associated with the second black colored grid image are synthesized, and the synthesized pixel gray scale is provided for the pixel of a corresponding position of the display panel.

Further, the display device is configured to display a 0 gray scale black image for brightness calibration, and display a first black-and-white grid image and a second black-and-white grid image respectively; the black and white grids of the first black-and-white grid image and the second black-and-white grid image are complementary to each other, and size of the first black-and-white grid image and the second black-and-white grid image is same as the pixel size of the display device; the acquiring device is further configured to locate the black and white grids in the first black-and-white grid image and the second black-and-white grid image.

Further, the color includes red, blue and green; and the display device respectively displays the first black-and-color grid image and the second black-and-color grid image as follows: the display device respectively displays the first black-and-red grid image, the second black-and-red grid image, the first black-and-green grid image, the second black-and-green grid image, and the first black-and-blue grid image, the second black-and-blue grid image; the first black-and-color grid image and the second black-and-color grid image are complementary to each other as follow: black and red grids of the first black-and-red grid image and the second black-and-red grid image are complementary to each other; black and green grids of the first black-and-green grid image and the second black-and-green grid image are complementary to each other; black and blue grids of the first black-and-blue grid image and the second black-and-blue grid image; size of the black and color grids of the first black-and-color grid image and the second black-and-color grid image are same as the pixel size of the display panel as follow: the black and color grids of the first black-and-red grid image and the second black-and-red grid image are same the pixel size of the display panel, the black and color grids of the first black-and-green grid image and the second black-and-green grid image are same as size of the pixel of the display panel, size of the black and color grids of the first black-and-blue grid image and the second black-and-blue grid image are same as the pixel size of the display panel.

Beneficial effects of the present invention: the present invention calibrates the pixel gray scale of the display device by way of compensation and algorithm to achieve brightness uniformity of the display screen and reduce or eliminate the speckle phenomenon caused by the AG cover.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
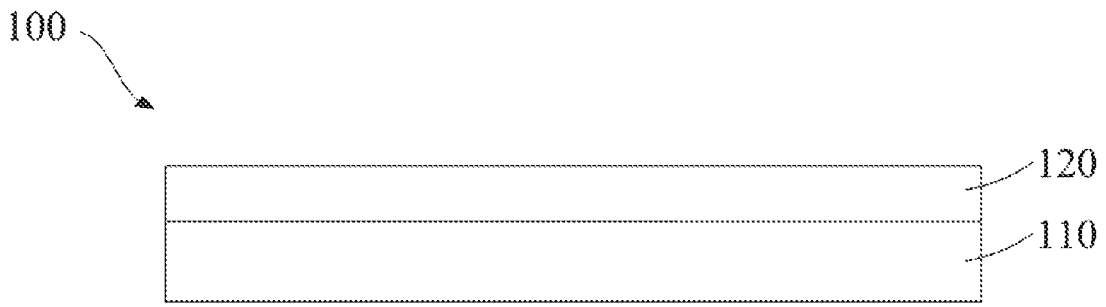
FIG. 1 is a schematic structure of a display device according to an embodiment of the present invention.

Hereinafter, embodiments of the present invention will be described in detail with reference to the accompanying drawings. However, the invention may be embodied in many different forms and should not be construed as limited to the specific embodiments set forth herein. Rather, these embodiments are provided to explain the principles of the invention and its practical application to thereby enable those of ordinary skill in the art to understand various embodiments of the invention and various modifications as are suited to the particular use contemplated.

In the drawings, the thickness of layers and regions is exaggerated for clarity. The same reference numbers indicate the same components throughout the specification and the drawings.

FIG. 1 is a schematic structure of a display device according to an embodiment of the present invention.

Referring to FIG. 1, a display device 100 according to an embodiment of the present invention includes a display panel 110 and an anti-glare anti-reflection (AG) cover 120 attached to the display panel 110. It should be understood that, the display device 100 may further include other necessary components. For example, when the display panel 110 is a liquid crystal panel, the display device 100 further includes a backlight module, a control component, and the like.

The display panel 110 may be, for example, a liquid crystal panel or an OLED display panel, but the present invention is not limited thereto. In addition, the display panel 110 has a high resolution, for example, a resolution of 1920*1080 As described in the background art, when the high-resolution display panel 110 is mounted with the anti-glare anti-reflection cover 120, speckle phenomenon may occur, which is unfavorable for the user to read.

Figure 2:
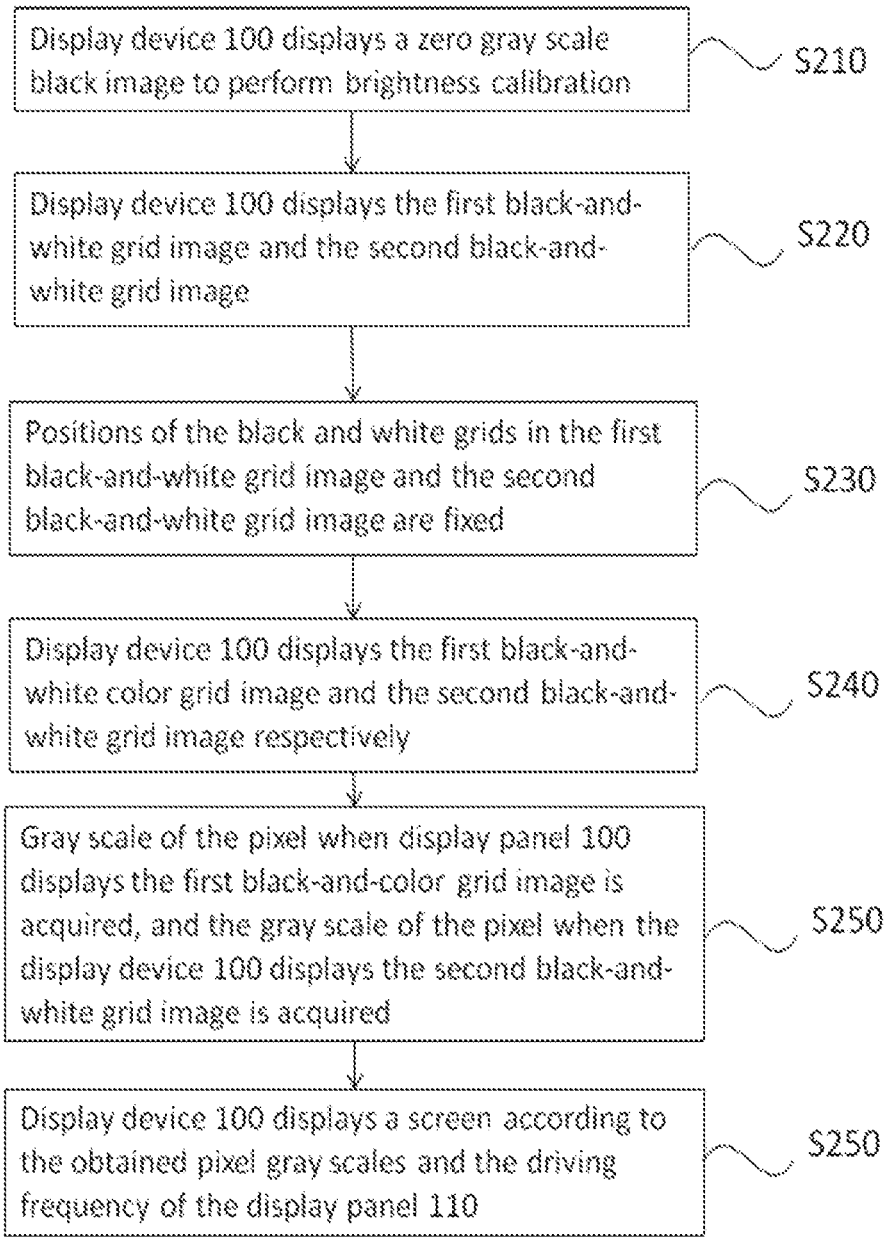
FIG. 2 is a flowchart of an improvement method for a speckle appearance of a display image according to an embodiment of the present invention.

In order to solve this problem, embodiments of the present invention firstly provide an improvement method for a speckle appearance of a display image, as shown in FIG. 2. FIG. 2 is a flowchart of an improvement method for a speckle appearance of a display image according to an embodiment of the present disclosure.

Referring to FIG. 2, in step S210, the display device 100 displays a zero gray scale black image to perform brightness calibration. This step S210 is a preferred brightness calibration step in order to make the subsequent method process more accurate. Therefore, as another embodiment of the present invention. This step S210 may be omitted.

Figure 3:
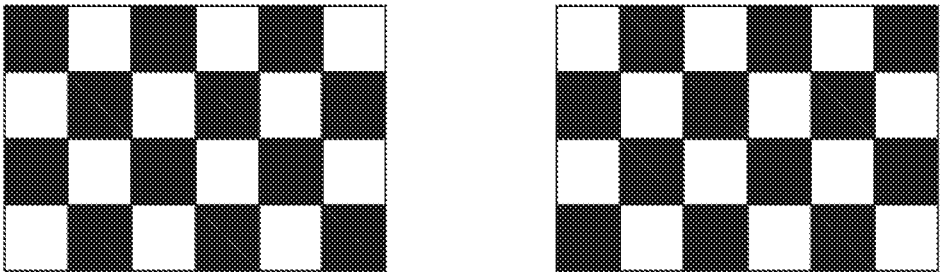
FIG. 3 is a schematic view of a first black-and-white grid image and a second black-and-white grid image according to an embodiment of the present invention.

In step S220, the display device 100 displays the first black-and-white grid image and the second black-and-white grid image respectively. FIG. 3 is a schematic diagram of a first black-and-white grid image and a second black-and-white grid image according to an embodiment of the present invention. Referring to FIG. 3, the left side is a first black-and-white grid image, the right side is a second black-and-white grid image, and the black-and-white grid image refers to the black grids and the white grids alternately arranged along the row direction and the column direction. The black and white grids of the first black-and-white grid image and the second black-and-white grid image are complementary to each other and the size of the black grids and the white grids of the first black-and-white grid image and the second black-and-white grid image are the same as the pixel size of the display panel 110. The number of the black grids and the white grids is the same as the number of the pixels of the display panel 110.

In step S230, the positions of the black and white grids in the first black-and-white grid image and the second black-and-white grid image are fixed. Specifically, the position of the black and white grids in the first black-and-white grid image and the second black-and-white grid image can be grasped using a CCD camera with a resolution of more than 4K.

In this manner, the crosstalk of the brightness and color of the grids in the grid image (including the previous black and white grid image and the subsequent black-and-red grid image, black-and-white grid image, and black-and-blue grid image) is prevented by the above steps S220 and S230. Therefore, steps S220 and S230 are preferable steps, and as another embodiment of the present invention, steps S220 and S230 may be omitted.

In step S240, the display device 100 displays the first black-and-white color grid image and the second black-and-white grid image respectively. In this embodiment, the colors include red, green and blue, but the present invention is not limited thereto.

Figure 4:
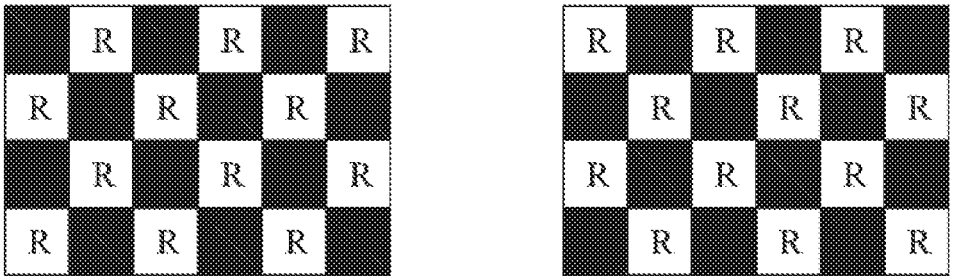
FIG. 4 is a schematic diagram of a first black-and-red grid image and a second black-and-red grid image according to an embodiment of the present invention.

FIG. 4 is a schematic diagram of a first black-and-red grid image and a second black-and-red grid image according to an embodiment of the present invention. Referring to FIG. 4, the left side is the first black-and-red grid image, the right side is the second black-and-red grid image, and the black-and-red grid image refers to the black grids and the red grids R arranged alternately along the row direction and the column direction. The black grids and the red s grids R of the first black-and-white grid image and the second black-and-white grid image are complementary to each other, and the size of the black grids and red grids R of the first and second black-and-red grid image are the same in pixel size of the display panel 110, and the number of the black grids and the red grids R is the same as the number of pixels of the display panel 110.

Figure 5:
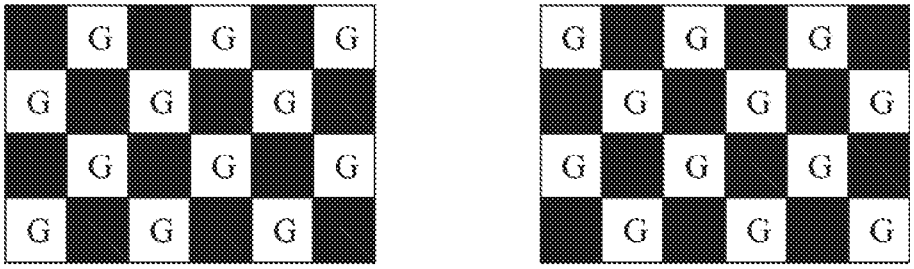
FIG. 5 is a schematic diagram of a first black-and-green grid image and a second black-and-green grid image according to an embodiment of the present invention.

FIG. 5 is a schematic view of a first black-and-green grid image and a second black-and-green grid image according to an embodiment of the present invention. Referring to FIG. 5, the left side is the first black-and-green grid image, and the right side is the black-and-green grid image. The black-and-green grid image refers to the black grids and the green grids G alternately arranged along the row and column directions. The black grids and the green grids G of the first black-and-green grid image and the second black-and-green grid image are complementary, and the sizes of the black grids and the green grids G of the first black-and-green grid image and the second black-and-green grid image are the same as pixel size of the display panel 110, and the number of the black grids and the green grids G is the same as the number of pixels of the display panel 110.

Figure 6:
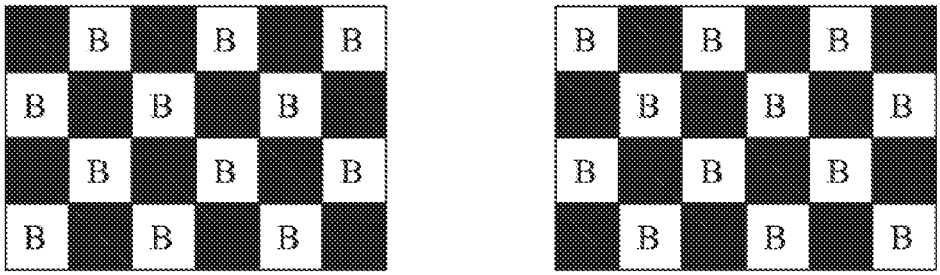
FIG. 6 is a schematic diagram of a first black-and-blue grid image and a second black-and-blue grid image according to an embodiment of the present invention.

FIG. 6 is a schematic diagram of a first black-and-blue grid image and a second black-and-blue grid screen according to an embodiment of the present invention. Referring to FIG. 6, the left side is a first black-and-blue grid image, and the right side is a second black-and-blue grid image. The black-and-blue grid image refers to that black grids and blue grids B are arranged alternately along the row direction and the column direction. The black grids and the blue grids of the first black and blue grid image and the second black-and-blue grid image are complementary to each other. The size of the black grids and the blue grids B of the first black-and-blue grid image and the second black-and-blue grid image B are same as the pixel size of the display panel 110, and number of the black grids and the blue grids B is the same as the number of the pixel in the display panel.

In step S250, the gray scale of the pixel when the display panel 100 displays the first black-and-color grid image is acquired, and the gray scale of the pixel when the display device 100 displays the second black-and-white grid image is acquired.

The pixel gray scale R1 of the first black-and-red grid image displayed by the display panel 100 is acquired by the CCD, and the pixel gray scale R2 of the second black-and-red grid image displayed by the display panel 100 is acquired by the CCD. The pixel gray scale G1 of the first black-and-green grid image displayed by the display panel 100 is acquired by the CCD, and the pixel gray scale R2 of the second black-and-green grid image displayed by the display panel 100 is acquired by the CCD. The pixel gray scale B1 of the first black-and-blue grid image displayed by the display panel 100 is acquired by the CCD, and the pixel gray scale B2 of the second black-and-blue grid image displayed by the display panel 100 is acquired by the CCD.

In step S260, the display device 100 displays a screen according to the obtained pixel gray scales and the driving frequency of the display panel 110.

If the driving frequency of the display panel 110 is 120 Hz, the obtained pixel gray scale is compensated. Further, the pixel grayscale R1 is compensated to R1'(=255/R1), the pixel grayscale R2 is compensated to R2'(=255/R2), and the pixel grayscale G1 is compensated to G1'(=255/G1), the pixel grayscale G2 is compensated to G2'(=255/G2), the pixel grayscale B1 is compensated to B1(=255/B1), and the pixel grayscale B2 is compensated to B2(='255/B2).

The compensated pixel gray scale R1', the compensated pixel gray scale G1' and the compensated pixel gray scale B1' are provided to the pixels of the corresponding color in the odd rows and odd columns of the display panel 110 (for example, compensated pixel gray scale R1' is provided to the red pixel, the compensated pixel gray scale G1' is provided to the green pixel, the compensated pixel gray scale B1' is provided to the blue pixel), and the pixels of the corresponding color in the even rows and even columns, and the compensation pixel gray scale R2', the compensated pixel gray scale G2' and the compensated pixel gray scale B2' are provided to the pixels of the corresponding color in the even rows and odd columns of the display panel 110 and the pixels of the corresponding color in the odd columns and the even rows of the display panel 110.

If the driving frequency of the display panel 110 is 60 Hz, the obtained pixel gray scales are compensated, and the compensated pixel gray scales related to the first black-and-color grid image and the compensated pixel gray scale related to the second black-and-color grid image are compensated pixel gray scale synthesized. Further, the pixel grayscale R1 is compensated to R1'(=255/R1), the pixel grayscale R2 is compensated to R2'(=255/R2), and the pixel grayscale G1 is compensated to G1'(=255/G1), the pixel grayscale G2 is compensated to G2'(=255/G2), the pixel grayscale B1 is compensated to B1'(=255/B1), and the pixel grayscale B2 is compensated to B2'(=255/B2) The compensated pixel gray scale R1' and the pixel gray scale R2' are synthesized into R0 according to the corresponding gamma curve. The compensated pixel gray scale G1' and the pixel gray scale G2' are synthesized into G0 according to the corresponding gamma curve, and the compensation. The rear pixel gray scale B1' and the pixel gray scale B2' are synthesized into B0 according to the corresponding gamma curve.

The synthesized pixel gray scale is provided to all the pixels of the display panel 110. For example, the synthesized pixel gray level R0 is provided to all the red pixels of the display panel 110. The synthesized pixel gray scale G0 is provided to all the green pixels of the display panel 110. The synthesized pixel gray scale B0 is provided to all of the blue pixel of the display panel 110.

Figure 7:
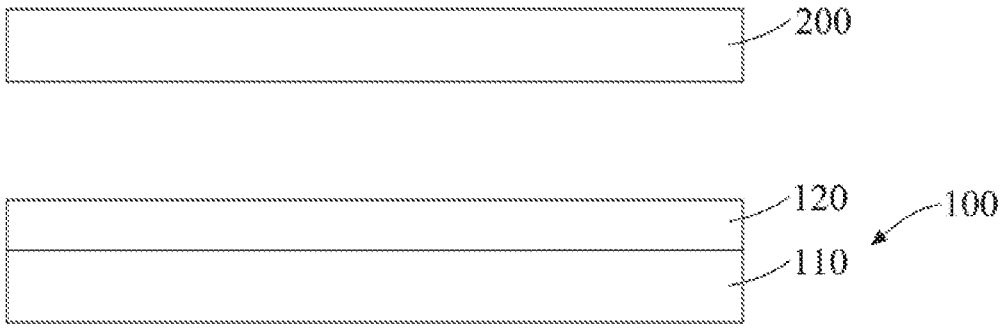
FIG. 7 is a schematic diagram of an improvement method for a speckle appearance of a display image according to an embodiment of the present invention.

An embodiment of the present invention further provides an improvement system for speckle phenomenon of a display image, as shown in FIG. 7. FIG. 7 is a schematic diagram of the improvement system for speckle phenomenon of the display image according to an embodiment of the present invention.

An improvement system for speckle phenomenon of a display image according to the embodiment of the present invention, as shown in FIG. 7, includes a display device 100 and an acquisition device 200. In this embodiment, the acquisition device 200 may be a CCD camera with a resolution exceeding 4K, but the present invention is not limited thereto.

The display device 100 displays a 0 gray scale black image to perform brightness calibration.

The display device 100 displays the first black-and-white grid image and the second black-and-white grid screen shown in FIG. 3 respectively.

The acquisition device 200 positions the black and white grids in the first black and white grid image and the second black and white grid image. Specifically, the acquisition device 200 captures the positions of the black-and-white grids in the first black-and-white grid screen and the second black-and-white grid image. In this way, it is possible to prevent crosstalk of the brightness and color of the grid in the grid image (including the black-and-white grid image and the subsequent black-and-white grid image, black-and-green grid screen, black-and-blue grid screen).

The display device 100 displays the first black-and-white color grid screen and the second black-and-white grid screen, respectively. In this embodiment, the colors include red, green and blue, but the present invention is not limited thereto. The display device 100 displays a first black-and-red grid image shown in FIG. 4 and a second black-and-red grid image, the first black-and-green grid image and the second black-and-green grid image shown in FIG. 5, and FIG. 6 shows the first black-and-blue grid screen and the second black-and-blue grid screen.

The acquiring device 200 captures the pixel 100 displays a pixel gray scale R1 of the first black-and-red grid image of the display device 100, and captures a pixel gray scale R2 of the second black-and-red grid image of the display device 100 and a pixel gray scale G1 of the first black-and-green grid image of the display device 100, and a pixel gray scale G2 of the second black-and-green grid image of the display device 100 and a pixel gray scale B1 of the first black-and-blue grid image of the display device 100, and a pixel gray scale B2 of the second black-and-blue grid image of the display device 100.

The display device 100 displays an image according to the obtained pixel gray scale and the driving frequency of the display panel 110.

If the driving frequency of the display panel 110 is 120 Hz, the display device 100 compensates for the obtained pixel gray scale. Further, the display apparatus 100 compensates the pixel grayscale R1 to R1'(=255/R1), and compensates the pixel grayscale R2 to R2'(=255/R2), and compensates for the pixel grayscale G1 to G1'(=255/G1), and compensates for the pixel grayscale G2 to G2'(=255/G2), and compensates for the pixel grayscale B1 to B1'(=255/B1), and compensates for the pixel gray scale B2 compensation to B2'(=255/B2).

The display apparatus 100 provides the compensated pixel grayscale R1', the compensated pixel grayscale G1' and the compensated pixel grayscale B1' to the pixels of the corresponding color in the odd rows of the display panel 110 (for example, after compensation grayscale pixels R1 'is supplied to the red pixel, the pixel gray level G1 compensated' to the green pixel, the pixel gray scale compensated B1' to the blue pixel) located in the respective colors and the even column pixels in even rows. And supplies the compensated pixel gray-scale R2', the compensated pixel gray-scale G2' and the compensated pixel gray-scale B2' to the pixels of the corresponding color in the even-numbered rows and even-numbered columns of the display panel 110. The corresponding color of the pixel.

If the driving frequency of the display panel 110 is 60 Hz, the display device 100 compensates for the obtained pixel gray scale, and the compensated pixel gray scales related to the first black-and-color grid image and the second black-and-color grid image are synthesized. Further, the display apparatus 100 compensates the pixel grayscale R1 to R1' (=255/R1), and compensates the pixel grayscale R2 to R2'(=255/R2), and compensates the pixel grayscale G1 as G1'(=255/G1), and compensates for the pixel grayscale G2 to G2'(=255/G2), and compensates the grayscale B1 to B1'(=255/B1), and compensates for the pixel grayscale B2 to B2'(=255/B2). The display device 100 synthesizes the compensated pixel grayscale R1' and the pixel grayscale R2' into R0 according to the corresponding gamma curve, and synthesizes the compensated pixel grayscale G1' and the pixel grayscale G2' into G0 according to the corresponding gamma curve, and synthesize the compensated pixel gray-scale B1' and the pixel grayscale B2' into B0 according to the corresponding gamma curve.

The display device 100 provides the synthesized pixel gray scale to all the pixels of the display panel 110. For example, the display device 100 provides the synthesized pixel gray level R0 to all red pixels of the display panel 110. The display device 100 provides the synthesized pixel gray level G0 to all the green pixels of the display panel 110. the display device 100 provides the synthesized pixel gray level B0 to all blue pixels of the display panel 110.

In summary, according to the embodiments of the present invention, the pixel gray scale of the display device is calibrated by means of compensation and algorithm to achieve brightness uniformity of the display screen and reduce or eliminate the speckle phenomenon caused by the AG cover.

Although the present invention is shown and described reference to particular embodiments, those skilled in the art will understand: without departing from the spirit and scope of the appended claims and their equivalents of the present invention, the case can be carried out in this form and various changes in detail.

What is claimed is:

1. An improvement method for a speckle appearance of a display image, comprising the steps of:

a display device respectively displaying a first black-and-color grid image and a second black-and-color grid image; wherein the display device comprises a display panel and an anti-glare cover attached to the display panel, black and color grids of the first black-and-color grid image and black and color grids of the second black-and-color grid image are complementary, and size of black and color grids of the first black-and-color grid image and the second black-and-color grid image is same as pixel size of the display panel, and number of the black grids and color grids is the same as number of pixels of the display panel;

acquiring a pixel gray scale of the first black-and-color grid image the display device displays, and a pixel gray scale of the second black-and-color grid image the display device displays; and the display device displaying an image according to the acquired pixel gray scales and a driving frequency of the display panel.

2. The improvement method according to claim 1, wherein the step of displaying the image according to the acquired gray scales of the pixels and the driving frequency of the display panel further comprises: compensating the acquired gray scales of the pixels, if the driving frequency of the display panel is 120 Hz; compensated pixel gray scales associated with the first black-and-color grid image are provided to pixels located in odd-numbered rows and odd-numbered columns and to pixels located in even-numbered rows and even-numbered columns, and compensated pixel gray scales associated with the second black-and-color grid image are provided to pixels located in the odd-numbered rows and odd-numbered columns and to pixels located in the even-numbered rows and even-numbered columns.

3. The improvement method according to claim 1, wherein the step of displaying the image according to the acquired pixel gray scales and the driving frequency of the display panel further comprises: compensating the acquired pixel gray scales if the driving frequency of the display panel is 60 Hz; synthesizing compensated pixel gray scales associated with the first black-and-color grid image and compensated pixel gray scales associated with the second black-and-color grid image; and providing the synthesized compensated pixel gray scales to pixels of corresponding positions of the display panel.

4. The improvement method according to claim 1, wherein before the display device separately displays the first black-and-color grid image and the second black color grid image, the improvement method further comprises: the display device displays a zero grayscale black image for brightness calibration; the display device respectively displays a first black-and-white grid image and a second black-and-white grid image; the black and white grids of the first black-and-white grid image and the second black-and-white grid image are complementary to each other, and size of black and white grids of the first black-and-white grid image and the second black-and-white grid image is the same as pixel size of the display device; and the display device positions the black and white grids in the first black-and-white grid image and the second black-and-white grid image.

5. The improvement method according to claim 1, wherein the color comprises red, blue and green;

the display device respectively displays the first black-and-color grid image and the second black-and-color grid image as follows: the display device respectively displays a first black-and-red grid image, a second black-and-red grid image, a first black-and-green grid image, a second black-and-green grid image, a first black-and-blue grid image, a second black-and-blue grid image;

the first black-and-color grid image and the second black-and-color grid image are complementary to each other as follow: black and red grids of the first black-and-red grid image and the second black-and-red grid image are complementary to each other; black-and-green grids of the first black-and-green grid image and the second black-and-green grid image are complementary to each other; black and blue grids of the first black-and-blue grid image and the second black-and-blue grid image are complementary to each other;

size of black and color grids of the first black-and-color grid image and the second black-and-color grid image is same as pixel size of the display panel as follows: size of black and color grids of the first black-and-red grid image and the second black-and-red grid image is same as pixel size of the display panel, size of black and color grids of the first black-and-green grid image and the second black-and-green grid image is same as pixel size of the display panel, and size of the black and color grids of the first black-and-blue grid image and the second black-and-blue grid image is same as pixel size of the display panel.

6. The improvement method according to claim 2, wherein the color comprises red, blue and green;

the display device respectively displays the first black-and-color grid image and the second black-and-color grid image as follows: the display device respectively displays the first black-and-red grid image, the second black-and-red grid image, the first black-and-green grid image, the second black-and-green grid image, the first black-and-blue grid image, and the second black-and-blue grid image;

the first black-and-color grid image and the second black-and-color grid image are complementary to each other as follows: black and red grids of the first black-and-red grid image and the second black-and-red grid image are complementary to each other; black and green grids of the first black-and-green grid image and the second black-and-green grid image are complementary to each other; black and blue grids of the first black-and-blue grid image and the second black-and-blue grid image are complementary to each other;

size of the black and color grids of the first black-and-color grid image and the second black-and-color grid image is same as pixel size of the display panel as follows: size of black and color grids of the first black-and-red grid image and the second black-and-red grid image is same as pixel size of the display panel, size of black and color grids of the first black-and-green grid image and the second black-and-green grid image is same as pixel size of the display panel, and size of black and color grids of the first black-and-blue grid image and the second black-and-blue grid image is same as pixel size of the display panel.

7. The improvement method according to claim 3, wherein the color comprises red, blue and green;

the display device respectively displays the first black-and-color grid image and the second black-and-color grid image as follows: the display device respectively displays the first black-and-red grid image, the second black-and-red grid image, the first black-and-green grid image, the second black-and-green grid image, the first black-and-blue grid image, and the second black-and-blue grid image;

the first black-and-color grid image and the second black-and-color grid image are complementary to each other as follow: black and red grids of the first black-and-red grid image and the second black-and-red grid image are complementary to each other; black and green grids of the first black-and-green grid image and the second black-and-green grid image are complementary to each other; black and blue grids of the first black-and-blue grid image and the second black-and-blue grid image are complementary to each other;

size of the black and color grids of the first black-and-color grid image and the second black-and-color grid image is same as pixel size of the display panel as follows: size of black and color grids of the first black-and-red grid image and the second black-and-red grid image is same as pixel size of the display panel, size of black and color grids of the first black-and-green grid image and the second black-and-green grid image is same as pixel size of the display panel, size of black and color grids of the first black-and-blue grid image and the second black-and-blue grid image is same as pixel size of the display panel.

8. An improvement system for sparkle phenomenon of a display image comprising: a display device and an acquisition device, the display device comprises a display panel and a cover glass bonded to the display panel;

the display device is configured to respectively display a first black-and-color grid image and a second black-and-color grid image; the black and color grids of the first black-and-color grid image and the second black-and-color grid image are complementary to each other; and size of black and color grids of the first black-and-color grid image and the second black-and-color grid image is the same as pixel size of the display panel;

the acquisition device is configured to acquire a pixel gray scale of the first black-and-color grid image the display device displays and a pixel gray scale of the second black-and-color grid image the display device displays;

the display device is further configured to display an image according to the acquired pixel gray scales and a driving frequency of the display panel.

9. The improvement system according to claim 8, wherein the display device is further configured to compensate the acquired pixel gray scales when the driving frequency of the display panel is 120 Hz, and compensated pixel gray scales associated with the first black-and-color grid image are provided to pixels located in odd-numbered rows and odd-numbered columns and to pixels are located in even-numbered rows and even-numbered columns, and compensated pixel gray scales associated with the second black-and-color grid image are provided to pixels located in the odd-numbered rows and odd-numbered columns and located in the even-numbered rows and even-numbered columns.

10. The improvement system according to claim 8, wherein the display device is further configured to compensate the acquired pixel gray scales when the driving frequency of the display panel is 60 Hz, the compensated pixel gray scales associated with the first black color grid image and the compensated pixel gray scales associated with the second black colored grid image are synthesized, and the synthesized pixel gray scale are provided for the pixel of corresponding positions of the display panel.

11. The improvement system according to claim 8, wherein the display device is configured to display a zero gray scale black image for brightness calibration, and display a first black-and-white grid image and a second black-and-white grid image respectively; the black and white grids of the first black-and-white grid image and the second black-and-white grid image are complementary to each other, and size of black-and-white grids of the first black-and-white grid image and the second black-and-white grid image is same as pixel size of the display device;

and an acquiring device further configured to locate the black and white grids in the first black-and-white grid image and the second black-and-white grid image.

12. The improvement system according to claim 8, wherein the color comprises red, blue, and green;

the display device respectively displays the first black-and-color grid image and the second black-and-color grid image as follows: the display device respectively displays a first black-and-red grid image, a second black-and-red grid image, a first black-and-green grid image, a second black-and-green grid image, a first black-and-blue grid image, a second black-and-blue grid image;

the first black-and-color grid image and the second black-and-color grid image are complementary to each other as follows: black and red grids of the first black-and-red grid image and the second black-and-red grid image are complementary to each other; black and green grids of the first black-and-green grid image and the second black-and-green grid image are complementary to each other; black and blue grids of the first black-and-blue grid image and the second black-and-blue grid image are complementary to each other;

size of black and color grids of the first black-and-color grid image and the second black-and-color grid image is same as pixel size of the display panel as follows: size of black and color grids of the first black-and-red grid image and the second black-and-red grid image is same as pixel size of the display panel, size of black and color grids of the first black-and-green grid image and the second black-and-green grid image is same as size of the pixel of the display panel, and size of black and color grids of the first black-and-blue grid image and the second black-and-blue grid image is same as pixel size of the display panel.

13. The improvement method according to claim 9, wherein the color comprises red, blue, and green;

the display device respectively displays the first black-and-color grid image and the second black-and-color grid image as follows: the display device respectively displays a first black-and-red grid image, a second black-and-red grid image, a first black-and-green grid image, a second black-and-green grid image, a first black-and-blue grid image, and a second black-and-blue grid image;

the first black-and-color grid image and the second black-and-color grid image are complementary to each other as follows: black and red grids of the first black-and-red grid image and the second black-and-red grid image are complementary to each other; black and green grids of the first black-and-green grid image and the second black-and-green grid image are complementary to each other; black and blue grids of the first black-and-blue grid image and the second black-and-blue grid image are complementary to each other;

size of the black and color grids of the first black-and-color grid image and the second black-and-color grid image is same as pixel size of the display panel as follows: size of black and color grids of the first black-and-red grid image and the second black-and-red grid image is same as pixel size of the display panel, size of black and color grids of the first black-and-green grid image and the second black-and-green grid image is same as pixel size of the display panel, and size of black and color grids of the first black-and-blue grid image and the second black-and-blue grid image is same as pixel size of the display panel.

14. The improvement method according to claim 10, wherein the color comprises red, blue, and green;

the display device respectively displays the first black-and-color grid image and the second black-and-color grid image as follows: the display device respectively displays a first black-and-red grid image, a second black-and-red grid image, a first black-and-green grid image, a second black-and-green grid image, a first black-and-blue grid image, and a second black-and-blue grid image;

the first black-and-color grid image and the second black-and-color grid image are complementary to each other as follows: black and red grids of the first black-and-red grid image and the second black-and-red grid image are complementary to each other; black and green grids of the first black-and-green grid image and the second black-and-green grid image are complementary to each other; black and blue grids of the first black-and-blue grid image and the second black-and-blue grid image are complementary to each other;

size of the black and color grids of the first black-and-color grid image and the second black-and-color grid image is same as pixel size of the display panel as follows: black and color grids of the first black-and-red grid image and the second black-and-red grid image is same as pixel size of the display panel, size of black and color grids of the first black-and-green grid image and the second black-and-green grid image is same as size of the pixel of the display panel, and size of black and color grids of the first black-and-blue grid image and the second black-and-blue grid image is same as pixel size of the display panel.

* * * * *